United States Patent [19]

Lloyd et al.

[11] 4,401,871

[45] Aug. 30, 1983

[54] HALOGENATED HYDROCARBON COMPOSITIONS AND ELECTRICAL APPARATUS CONTAINING SUCH COMPOSITIONS

[75] Inventors: Harold Lloyd, Christchurch; John Coxon, Halton, both of England

[73] Assignee: Imperial Chemical Industries PLC, London, England

[21] Appl. No.: 339,308

[22] Filed: Jan. 15, 1982

[30] Foreign Application Priority Data

Jan. 14, 1981 [GB] United Kingdom ..... 8101014

[51] Int. Cl.[3] ..... H01H 33/68; H01B 3/24

[52] U.S. Cl. ..... 200/150 A; 174/17 LF; 200/153 M; 252/570; 252/580; 252/581; 570/134; 570/181; 585/6.3; 585/6.6

[58] Field of Search ..... 252/570, 580, 581; 200/150 A, 153 M; 585/6.3, 6.6; 174/17 LF; 570/134, 181

[56] References Cited

U.S. PATENT DOCUMENTS 2,214,877 9/1940 Clark ..... 570/181

2,421,241 5/1947 Clark ..... 200/150 A

*Primary Examiner*—John E. Kittle

*Assistant Examiner*—Robert A. Wax

*Attorney, Agent, or Firm*—Cushman, Darby & Cushman

[57] ABSTRACT

A liquid halogenated hydrogenated hydrocarbon composition suitable for use as a dielectric and/or arc-extinguishing fluid in electrical apparatus, which comprises (a) a major proportion by weight of one or more halogenated paraffinic hydrocarbons having at least 8 carbon atoms and containing from 40% to 70% by weight of halogn based on the halogenated paraffinic hydrocarbon, and (b) a minor proportion by weight of at least one non-flammable viscosity-reducing additive for the halogenated paraffinic hydrocarbon (a) which contains at least 50% by weight of halogen based on the additive and is a halogenated aliphatic hydrocarbon containing from 2 to 6 carbon atoms.

Suitable electrical apparatus may comprise a circuit interruption device such as a switchgear.

13 Claims, No Drawings

HALOGENATED HYDROCARBON COMPOSITIONS AND ELECTRICAL APPARATUS CONTAINING SUCH COMPOSITIONS

This invention relates to halogenated hydrocarbon compositions which are dielectric media and/or arc-extinguishing media suitable for use in electrical apparatus, and to electrical apparatus containing such compositions. The compositions are suitable for use, for example in switchgear, ring main units, switch disconnectors, circuit breakers and fuses and any combinations thereof.

A common form of electrical circuit interruption device comprises a switch or other circuit-breaking device of which at least the electrical contacts are immersed in a fluid medium such that upon operation of the circuit-breaking device the fluid serves to quench the arc which results from causing relative movement of the electrical contacts. Hitherto, the fluid medium most commonly used in devices of the type described has been a hydrocarbon oil known as a petroleum oil. It is known, however, that hydrocarbon oils suffer from the disadvantage of being subject to decomposition by electric arcs with the formation of flammable and explosive gases such that under abnormal operating conditions and/or prolonged periods of use a catastrophic failure of the electrical circuit interruption device may occur.

The present invention resides in the discovery of a halogenated hydrocarbon composition which is suitable for use in electrical apparatus such as circuit interruption devices and which does not suffer from the disadvantages of hydrocarbon (petroleum) oils.

According to the present invention there is provided a liquid halogenated hydrocarbon composition suitable for use as a dielectric and/or arc-extinguishing fluid in electrical apparatus which comprises (a) a major proportion by weight of one or more halogenated paraffinic hydrocarbons having at least 8 carbon atoms and containing from 40% to 70% by weight of halogen based on the halogenated paraffinic hydrocarbon, and (b) a minor proportion by weight of at least one non-flammable viscosity-reducing additive for the halogenated paraffinic hydrocarbon(s) which contains at least 50% by weight of halogen based on the additive and is a halogenated aliphatic hydrocarbon or a halogenated aromatic hydrocarbon having a single aromatic nucleus.

The halogenated paraffinic hydrocarbon may be derived from a single paraffinic hydrocarbon having 8 or more carbon atoms but will usually be derived from a mixture of paraffinic hydrocarbons having 8 or more carbon atoms. Halogenated mixed paraffinic hydrocarbons suitable for use in the compositions are available commercially, typical mixtures being based for example upon $C_{10}$ to $C_{13}$ paraffinic hydrocarbons, and $C_{14}$ to $C_{17}$ paraffinic hydrocarbons. Preferably the halogenated paraffinic hydrocarbon component of the composition is a fairly mobile liquid and for this reason we prefer to use compounds in which the number of carbon atoms is less than 20. However halogenated paraffinic hydrocarbons which are of high viscosity at normal temperatures and pressures may be used providing the composition formed by mixing them with the viscosity-reducing additive(s) is a liquid.

The halogenated paraffinic hydrocarbon will usually be a chlorinated paraffinic hydrocarbon and the chlorine content typically will be from 45% to 65% by weight based on the halogenated paraffinic hydrocarbon, preferably from 50% to 60% by weight. In the case of chlorinated mixed paraffinic hydrocarbons, these will usually be prepared by chlorinating a mixture of the paraffinic hydrocarbons rather than mixing individually chlorinated paraffinic hydrocarbons so that the halogen contents referred to throughout this specification refer to the total chlorine content of the mixture based upon the total halogenated paraffinic hydrocarbon content of the mixture. In such mixtures it is not essential that the chlorine content of the individual chlorinated paraffinic hydrocarbons be the same as the overall chlorine content of the mixture, although desirably each chlorinated paraffinic hydrocarbon in the mixture contains at least 40% by weight of chlorine.

The halogenated paraffinic hydrocarbon component of the composition imparts satisfactory dielectric and/or arc-extinguishing properties to the composition but these materials are not sufficiently mobile for use alone in electrical circuit interruption devices. It is desirable, however, that the amount of this component of the composition be as large as possible consistent with the composition having adequate mobility for use in electrical circuit interruption devices. In general the compositions will have a viscosity of less than 100 centistokes (cS) at 25° C. (Brookfield viscometer) although we do not exclude compositions having a viscosity greater than 100 cS at 25° C. The compositions contain greater than 50% by weight based on the composition of the halogenated paraffin hydrocarbon(s) and usually they will contain at least 65% by weight, preferably at least 75% by weight, of this component. The amount of the halogenated paraffinic hydrocarbon component will be dependent upon the initial viscosity of this component and the degree of viscosity reduction achieved using a particular viscosity-reducing additive, and may be as high as 95% by weight, or even higher in some cases.

The viscosity-reducing additive will usually be incorporated in the halogenated paraffinic hydrocarbon in an amount just sufficient to provide adequate mobility of the composition. Usually this amount will be less than 35% by weight of the composition and typically will be from 10% to 30% by weight of the composition. The optimum amount of the additive required is easily determined and usually will be sufficient to ensure that the composition remains adequately mobile at the lowest temperatures which it is likely to encounter in use, such operating temperatures often being sub-zero temperatures.

As stated, the viscosity-reducing additive is a halogenated hydrocarbon containing at least 50% by weight of halogen. The additive will usually be a liquid of low viscosity, for example below 5 cS at 25° C. (Brookfield viscometer) although we have observed that additives which themselves are solids may, when incorporated in the halogenated paraffinic hydrocarbon, provide a composition which is a liquid of low viscosity, i.e. compounds which themselves are solids may nevertheless be used as viscosity-reducing additives for the halogenated paraffinic hydrocarbon.

The additive may be a halogenated saturated or ethylenically unsaturated aliphatic hydrocarbon or a halogenated aromatic hydrocarbon having a single aromatic nucleus, for example a halobenzene or halotoluene. Usually the halogen in the additive, or at least a major proportion by weight of the halogen, will be chlorine. Chlorohydrocarbons and chlorofluorohydrocarbons are the preferred halogenated hydrocarbons. Usually the halogenated aliphatic hydrocarbon will be a halogenated lower aliphatic hydrocarbon containing less than 6 carbon atoms in the molecule and we prefer compounds containing at least 2 carbon atoms. Halogenated cycloaliphatic compounds may be used, for example halocyclopentanes containing 3 or 4 halogen atoms. Especially preferred are halogenated lower aliphatic hydrocarbons containing 2 or 3 carbon atoms. Examples of halogenated lower aliphatic hydrocarbons which may be used are carbon tetrachloride, hexachloroethane, perchloroethylene, trichloroethylene, 1,1,2-trichloro-1,2,2-trifluoroethane, tetrachlorodifluoroethane, tetrachlorotetrafluoropropane and dichlorotetrafluoroethane. Fully-halogenated aliphatic compounds (perhaloaliphatic compounds) are preferred although compounds containing one or more hydrogen atoms may be used if desired, provided that in use of the composition to extinguish electric arcs such compounds do not give rise to flammable or unduly toxic degradation products.

Any halogenated benzene or halogenated toluene may be used which is a viscosity-reducing additive for the halogenated paraffinic hydrocarbon and which contains at least 50% by weight of halogen. Examples of suitable compounds are trichlorobenzene, tetrachlorobenzene and various chloro- and chlorofluoro-toluenes.

If desired, mixtures of viscosity-reducing additives may be employed.

The compositions of the present invention are clear, essentially-colourless liquids having low pour points and low cloud points. Pour points and cloud points below 0° C., for example pour points below −30° C. and cloud points below −10° C. are readily achieved by suitable choice of the viscosity-reducing additive employed and the amount thereof. The viscosity of the compositions increases as their temperature decreases but in general compositions having a viscosity at 25° C. of less than 100 cS will remain adequately mobile when cooled to below −10° C., for example will have a viscosity of less than 750 cS at −10° C. It is desirable that the cloud point of the composition also be below −10° C. so that the composition does not have a cloudy appearance when cooled to such temperatures, although some cloudiness in the composition at sub-zero temperatures may be acceptable provided the cloudiness disappears when the composition is warmed to normal operating temperatures and there is no separation of the components of the composition.

The compositions exhibit high volume resistivities as is desirable in dielectric and arc-extinguishing media. Volume resistivities greater than $4\times10^{10}$ ohms/cm and often as high as $2\times10^{11}$ ohms/cm may be achieved by suitable choice of the components of the composition and the amounts thereof in the composition. We have observed that incorporation of the defined viscosity-reducing agents in the halogenated paraffinic hydrocarbon composition generally results in a composition of higher volume resistivity than is exhibited by the halogenated paraffinic hydrocarbon alone.

The halogenated paraffinic hydrocarbons in general are non-flammable and exhibit excellent resistance to degradation by flames and electric arcs. The compositions of the invention also are non-flammable and exhibit satisfactory resistance to degradation by flames and electric arcs; in particular the resistance to degradation and arc-extinguishing properties of the halogenated paraffinic hydrocarbon is not seriously impaired by incorporating therein the defined viscosity-reducing additives.

Use of the compositions as the fluid in an electrical circuit interruption device provides a device which is inherently less susceptible to being dangerous to an operator of the device than is a similar device incorporating a conventional hydrocarbon oil (petroleum oil) fluid. This use of the compositions is provided according to a further feature of the present invention.

The compositions of the invention may contain one or more stabilizing additives for the halogenated paraffinic hydrocarbon and/or the viscosity-reducing additive.

The compositions may be used in conventional electrical circuit interruption devices incorporating a dielectric and/or arc-extinguishing fluid and such devices may be of the sealed-unit or open-unit types. Conventional devices do not require modification to render them suitable for protection by the compositions of the invention.

The present invention includes within its scope electrical apparatus incorporating a dielectric and/or arc extinguishing fluid comprising (a) a major proportion by weight of one or more halogenated paraffinic hydrocarbons having at least 8 carbon atoms and containing from 40% to 70% by weight of halogen based on the halogenated paraffinic hydrocarbon, and (b) a minor proportion by weight of at least one non-flammable viscosity-reducing additive for the halogenated paraffinic hydrocarbon(s) which contains at least 50% by weight of halogen based on the additive and is a halogenated aliphatic hydrocarbon or a halogenated aromatic hydrocarbon having a single aromatic nucleus.

In particular, the apparatus may be electrical switchgear having relatively movable contacts totally immersed in said fluid. The fluid, in this case, acts as a dielectric and as an arc-extinguishing medium. The use of the viscosity-reducing additive enables the contacts to move with much less physical impedance due to the fluid than is possible if the halogenated paraffinic hydrocarbon(s) were used without the additive.

The fluid also finds use as a dielectric fluid in switchgear in which the contacts operate in a vacuum or in an electronegative gas (e.g. sulphur hexafluoride) or liquid; in this case the contacts would operate in separate chambers with the dielectric fluid around said chambers, thereby enabling the switchgear to be made much more compact.

Switchgear employing the above-described fluid may have this fluid in a totally enclosed housing or in a housing vented to atmosphere.

The invention is illustrated but in no way limited by the following examples.

EXAMPLE 1

A chlorinated mixture of paraffinic hydrocarbons having 10 to 13 carbon atoms and containing 56% by weight of chlorine, which mixture contained 0.2% by weight of epoxidised soya bean oil as a stabilizing additive (the mixture being available under the trade name "Cereclor" 56L from Imperial Chemical Industries PLC) was blended by stirring with 30% by weight based on the resulting composition of 1,1,2-trichloro-1,2,2-trifluoroethane in oven-dried glassware. 0.2% by weight of precipitated silica ("Ultrasil" VN3 available from Imperial Chemical Industries PLC) was added to the blend which was then shaken for 20 minutes at room temperature and then heated in an oven at 40° C. overnight. The resulting blend was cooled, and the precipitate was separated by decanting the liquid composition from it. The liquid composition was filtered through an oven-dried No 4 sintered glass filter.

The liquid composition was subjected to testing to determine the following properties:

Viscosity
at (i) 25° C. and (ii) 10° C. using Brookfield and U-tube viscometers.
Pour Point—according to ASTM D97
Cloud Point—according to ASTM D2500
Volume Resistivity—according to ERA Technical Report L/T 375, 1958, which is the standard method of the Electrical Research Association The results of the measurements are given in Table 1 below.

The above procedure was repeated six times (Experiments 2 to 7) using the following combinations of chlorinated paraffinic hydrocarbons (CPH) and viscosity-reducing additives (VRA). In each case the 'Cereclor' contained 0.2% by weight of epoxidised soya bean oil as a stabilising additive.

'Cereclor' 60L is a chlorinated mixture of paraffinic hydrocarbons having 10 to 13 carbon atoms and containing 60% by weight of chlorine.

'Cereclor' S52 is a chlorinated mixture of paraffinic hydrocarbons having 14 to 17 carbon atoms and containing 52% by weight of chlorine.

'Cereclor' 50LV is a chlorinated mixture of paraffinic hydrocarbons having 10 to 13 carbon atoms and containing 49% by weight of chlorine.

TABLE 1

| Experiment No | Viscosity (cS) −10° C. | Viscosity (cS) 25° C. | Pour Point (°C.) | Cloud Point (°C.) | Volume Resistivity (ohm/cm) |
|---|---|---|---|---|---|
| 1 | 300 | 36 | −37 | −16 | $8.5 \times 10^{11}$ |
| 2 | 450 | 86 | — | — | $7.9 \times 10^{10}$ |
| 3 | 480 | 32 | −34 | −7 | $1 \times 10^{11}$ |
| 4 | 600 | 51 | — | — | $1.73 \times 10^{11}$ |
| 5 | 200 | 22 | — | — | $4.8 \times 10^{10}$ |
| 6 | 500 | 42 | −48 | −32 | $5.0 \times 10^{10}$ |
| 7 | 400 | 33 | −46 | −7 | $5.9 \times 10^{10}$ |
| Comparison | — | 160 | −10 | — | $2 \times 10^{10}$ |

The above results show that each of the compositions 1 to 6 exhibits viscosity characteristics and volume resistivity properties which render it suitable for use as the dielectric and/or arc-extinguishing fluid in electrical apparatus such as circuit interruption devices, for example switchgear. Each of compositions 1 to 6 meets electrical breakdown strengths as given in B.S. 148, 1972.

The suitability of the compositions for such use was confirmed by separate experiments in which 'Cereclor' 56L and 1,1,2-trichloro-1,2,2-trifluoroethane were tested in electrical switchgear under normal and abnormal operating conditions including catastrophic failure of the switchgear. The catastrophic failure conditions were three-phase 12 KV and 8 KA for 240 milliseconds. In both cases the materials were found not to be flammable or explosive or to yield flammable or explosive decomposition products even under conditions of catastrophic failure of the switchgear, and any decomposition products formed did not give rise to an unacceptable toxicity hazard.

The switchgear used in the tests was high voltage switchgear rated at three-phase 12 KV, normal current rating 400/630 amp and fault-making capacity 33.4 KAmp, having a three-phase switch mechanism and having a steel chamber with a capacity of about 70 liters of dielectric and arc-extinguishing fluid. The three-phase switch mechanism comprised a separate set of fixed and moving electrical contacts operated by a stored-energy unit. The contacts of the switch mechanism were immersed in the fluid under all normal operating conditions of the switchgear.

EXAMPLE 2

Blends of "Cereclor" chlorinated paraffinic hydrocarbons with viscosity-reducing additives were prepared according to the formulations given in Table 2 below. Each blend was prepared in a 20 liter capacity vessel fitted with a paddle-stirrer. A 10 liter batch of the 'Cereclor'/viscosity-reducing additive blend was charged to the vessel and stirred for 30 minutes with activated alumina (10% by weight based on the composition) and precipitated silica (1% by weight based on the composition). The silica was "Ultrasil" VN3.

After being stirred for 30 minutes, the blend was heated at 40°–50° C. for 7 hours with continuous stirring and was then filtered under pressure to remove the alumina and silica particles.

The volume resistivity of each blend after cooling to room temperature was determined as described in Example 1 and the results are shown in Table 2.

Each of the compositions 1 to 6 meets electrical breakdown strengths as given in B.S. 148, 1972.

| Experiment No | CPH | VRA | Proportions CPH/VRA (% w/w) |
|---|---|---|---|
| 2 | 'Cereclor' 56L | tetrachlorotetrafluoropropane | 70/30 |
| 3 | 'Cereclor' 56L | trichlorobenzene | 70/30 |
| 4 | 'Cereclor' 60L | tetrachlorodifluoroethane | 65/35 |
| 5 | 'Cereclor' S52 | perchloroethylene | 65/35 |
| 6 | 'Cereclor' 50LV | 1,1,2-trichloro-1,2,2-trifluoroethane | 90/10 |
| 7 | 'Cereclor' 50LV | trichlorobenzene/hexachloroethane | 85/10/5 |
| Comparison | *'Cereclor' 56L | None | — |

*Untreated 'Cereclor' 56L (i.e. not treated with silica)

| Expt | CPH | VRA | CPH/VRA (% w/w) | VR (ohm/cm) |
|---|---|---|---|---|
| 1 | 'Cereclor' 50LV | trichlorobenzene/hexachloroethane | 85/10/5 | $4.3 \times 10^{10}$ |
| 2 | 'Cereclor' 50LV | tetrachlorodifluoroethane | 85/15 | $6.1 \times 10^{10}$ |
| 3 | 'Cereclor' 50LV | perchloroethylene | 90/10 | $4.3 \times 10^{10}$ |

-continued

| Expt | CPH | VRA | CPH/VRA (% w/w) | VR (ohm/cm) |
|---|---|---|---|---|
| 4 | 'Cereclor' 50LV | dichlorobenzotrifluoride | 90/10 | $7.4 \times 10^{10}$ |
| 5 | 'Cereclor' 56L | trichlorobenzene | 70/30 | $1.3 \times 10^{11}$ |
| 6 | 'Cereclor' 56L | perchloroethylene | 75/25 | $1.4 \times 10^{11}$ |

We claim:

1. A liquid halogenated hydrocarbon composition suitable for use as a dielectric and/or arc-extinguishing fluid in electrical apparatus, which comprises (a) a major proportion by weight of one or more halogenated paraffinic hydrocarbons having at least 8 carbon atoms and containing from 40% to 70% by weight of halogen based on the halogenated paraffinic hydrocarbon, and (b) a minor proportion by weight of at least one non-flammable viscosity-reducing additive for the halogenated paraffinic hydrocarbon (a) which contains at least 50% by weight of halogen based on the additive and is a halogenated aliphatic hydrocarbon containing from 2 to 6 carbon atoms.

2. A composition as claimed in claim 1 wherein the amount of the halogenated paraffinic hydrocarbon (a) is from 65% to 95% by weight of the composition.

3. A composition as claimed in claim 1 or claim 2 wherein the amount of the viscosity-reducing additive (b) is from 10% to 30% by weight of the composition.

4. A composition as claimed in claim 1 having a viscosity of less than 100 centistokes at 25° C.

5. A composition as claimed in claim 1 having a volume resistivity greater than $4 \times 10^{10}$ ohm/cm.

6. A composition as claimed in claim 1 wherein the halogenated paraffinic hydrocarbon (a) contains less than 20 carbon atoms.

7. A composition as claimed in claim 1 wherein the halogenated paraffinic hydrocarbon (a) is a chlorinated paraffinic hydrocarbon of chlorine content from 50% to 60% by weight.

8. A composition as claimed in claim 1 wherein the viscosity-reducing additive is 1,1,2-trichloro-1,2,2-trifluoroethane.

9. Use of a composition as claimed in claim 1 as a dielectric and/or arc-extinguishing fluid in electrical apparatus.

10. Electrical apparatus containing a dielectric and/or arc-extinguishing fluid which is a composition as claimed in claim 1.

11. Electrical apparatus as claimed in claim 10 comprising a circuit interruption device.

12. Electrical apparatus as claimed in claim 11 comprising switchgear.

13. Electrical apparatus as claimed in claim 12 comprising switchgear having relatively moveable contents immersed in the fluid.

* * * * *